US006166340A

United States Patent [19]

Hörmann

[11] Patent Number: 6,166,340

[45] Date of Patent: Dec. 26, 2000

[54] ELECTRICAL CONTACT COMPONENTS FOR GATE SWITCH

[75] Inventor: Michael Hörmann, Halle, Germany

[73] Assignee: Marantec Antriebs-und Steuerungstechnik GmbH & Co. Produktions KG, Marienfeld, Germany

[21] Appl. No.: 09/061,650

[22] Filed: Apr. 17, 1998

[30] Foreign Application Priority Data

Apr. 18, 1997 [DE] Germany ..... 297 07 006 U

[51] Int. Cl.[7] ..... H01H 3/16; H01H 1/12

[52] U.S. Cl. ..... 200/61.71; 200/61.73

[58] Field of Search ..... 200/16 R, 16 C, 200/16 D, 61.7, 61.71–61.75

[56] References Cited

U.S. PATENT DOCUMENTS 4,556,765 12/1985 Shaw et al. ..... 200/61.71

FOREIGN PATENT DOCUMENTS 872860 10/1998 European Pat. Off. ..... H01H 3/16

2521020 11/1976 Germany .

2144272 2/1985 United Kingdom .

*Primary Examiner*—J. R. Scott

*Attorney, Agent, or Firm*—Dillworth & Barrese

[57] ABSTRACT

The invention concerns contact components for a limit switch for gate drives, namely at least one first contact component and at least one second contact component, wherein one of the contact components is arranged to move when the gate is opened or closed. At least the first contact component has a preferably arc-shaped side extending in the direction of contact with the second contact component; the second contact component is flexible in this direction.

20 Claims, 4 Drawing Sheets

ELECTRICAL CONTACT COMPONENTS FOR GATE SWITCH

BACKGROUND OF THE INVENTION

The invention concerns an electrical contact for limit switch for gate drives with at least one first contact component and at least one second contact component, in which one of the contact components is arranged such that it is moved upon opening or closing the gate.

Such limits switches for gate drives, for example, of sectional gates or swinging gates, are known. They generally include two or more contact components, of which one is moved upon the closing and opening of the gate, while the other one is generally placed at a fixed location. The function of a gate drive consists in that in a limit position of the gate, an electric contact is created between the movable and the fixed contact components by the contact between the contact components, by which a signal is produced or interrupted such that the gate drive comes to a stop. In previously-known limit switches for gate drives, contact components were used whose orientation to each other can shift over extended operating times based on undesired deformations or wear in such manner that in the limit position of the gate, an electric contact between the contact components does not occur or occurs unreliably. The resultant malfunction of the gate can lead not only to substantial material damage, but may also endanger persons if, for example, the fixed minimum height of a sectional gate is not achieved.

SUMMARY OF THE INVENTION

The object of this invention is to improve the generic device such that reliable function is always guaranteed even after long operating periods.

This object is largely solved by the generic limit switch in that at least a first contact component has a preferably arc-shaped side extending in the direction of the contact point with a second contact component, and the second contact component is designed to be flexible in this direction. This results in the first, preferably arc-shaped contact component contacting the second, flexible contact component even before the limit position of the gate is reached and elastically deforms the second contact component in the limit position of the gate. The resultant compressive force acting in the direction of the contact point in the limit position of the gate causes an electric contact to be created between the two contact components. This is still the case when, after extended operating periods, the contact components suffer deformations or wear that could lead to a malfunction in the generic devices. It is irrelevant, which of the contact components is movable and which of the contact components is fixed during the opening and closing of the gate for the reliable function of the device pursuant to the invention.

Pursuant to a preferred method of embodiment of this invention, the contact components can be placed on contact frames where one of the contact frames is moved when the gate opens and closes while the other contact frame is in a fixed location. The arrangement of the contact components on the contact frames has the advantage that with a corresponding detachable design, it is easy to exchange the contact components for contact components of different design and/or size.

The movable contact frame can be placed on a cradle attached to a drive component on the gate drive. Such cradles are generally used to make a connection between the gate and/or the rod assembly connected to the gate and the gate drive, preferably designed as a belt or chain. The cradle attached to the drive components creates movement between two limit points, when the gate opens and closes, and is therefore suitable for acceptance of a contact frame on which one of the contact components is arranged.

In another embodiment of the invention, a second contact component has a contact shoe that can be placed on a projection; the contact shoe and/or the projection is/are designed to be elastic. The use of a simple contact shoe as the contact component enables inexpensive design of the device pursuant to the invention. The contact shoes can be placed on the projection, which guarantees exchangeability. Since the contact shoe and/or the projection is/are designed to be elastic, a force is exerted in the direction of the contact point when the two contact components touch that enables a constant, sure formation of the electric contact.

One or more projections arranged on a contact frame can be provided for acceptance of the contact components.

In another embodiment of this invention, one or more projections are arranged on a receptacle that can be inserted into the contact frame. This provides the device pursuant to the invention with a high degree of flexibility since changing the receptacle enables the use of first and second contact components with different spacings without having to change the whole contact frame. This embodiment further permits the receptacle to be produced while the corresponding connections and the whole contact frame need not be made of an electrically-conductive material. It would be conceivable for the receptacle to be made with electrically-conductive projections and for the contact frame to be made of plastic.

It is particularly advantageous for the electric contact to be created by contact of the first with the second contact component. As soon as the two second contact components are connected through the first contact component, an electrical connection is created that leads to the gate being held in the desired limit position. The flexible design of the second contact component in this case also means a secure, reliable electrical connection is guaranteed by means of the first contact component.

The first contact component can be formed of wire bent in the direction of the contact point with the second contact component, resulting in a simple, inexpensive design.

For a flexible embodiment of the limit switch pursuant to the invention, the contact component that is fixed in location when the door is opening or closing can be mounted at various locations spaced from each other in a direction of motion of the movable contact component. This results in the advantage that different switch positions for the limit switch, selectable at choice, and thus different desirable limit positions for the gate can be created. Such an embodiment is particularly advantageous when the limit switch is used for gates of varying heights and/or limit positions.

In another embodiment of the invention, the fixed-location contact frame is mounted at varying positions spaced away from each other in the direction of motion of the movable contact component. This results in not the contact component per se, but rather the contact frame on which the contact component is located, being displaced.

In the preferred embodiment of the invention, the fixed-location contact frame is mounted detachably on a contact strip. Based on the detachable mounting, it is possible to place the contact frame in different positions, enabling a fine adjustment of the limit position of the gate drive.

The contact strip and the fixed-location contact frame can have shaped areas where the shaped area of the contact strip is shaped according to the negative image of the fixed-location contact frame. The shaped areas can have one or more grooves and/or projections. The adjustability of the limit point of the gate drive is thus a function of the raising or lowering of the shaped area. If, for example, the shaped area of the contact strip has a tooth profile, for a specific travel of the contact frame, it suffices if it has only one projection that penetrates into the corresponding tooth profile of the contact strip.

Coarse adjustment of the limit point of the gate drive can be achieved by applying the contact strip on a carrier, a projection or a wall in a detachable manner, with adhesive, preferably adhesive strips. In connection with such a relatively inaccurate mounting of the contact strip, fine adjustment can be created by means of the shaped area of the contact strip and the contact frame, and thus precise establishment of the limit point of the gate drive is achieved.

BRIEF DESCRIPTION OF THE DRAWINGS

Additional details and advantages can be seen from the method of embodiment shown in the drawings.

DESCRIPTION OF THE PREFERRED EMBODIMENT(S)

Figure 1:
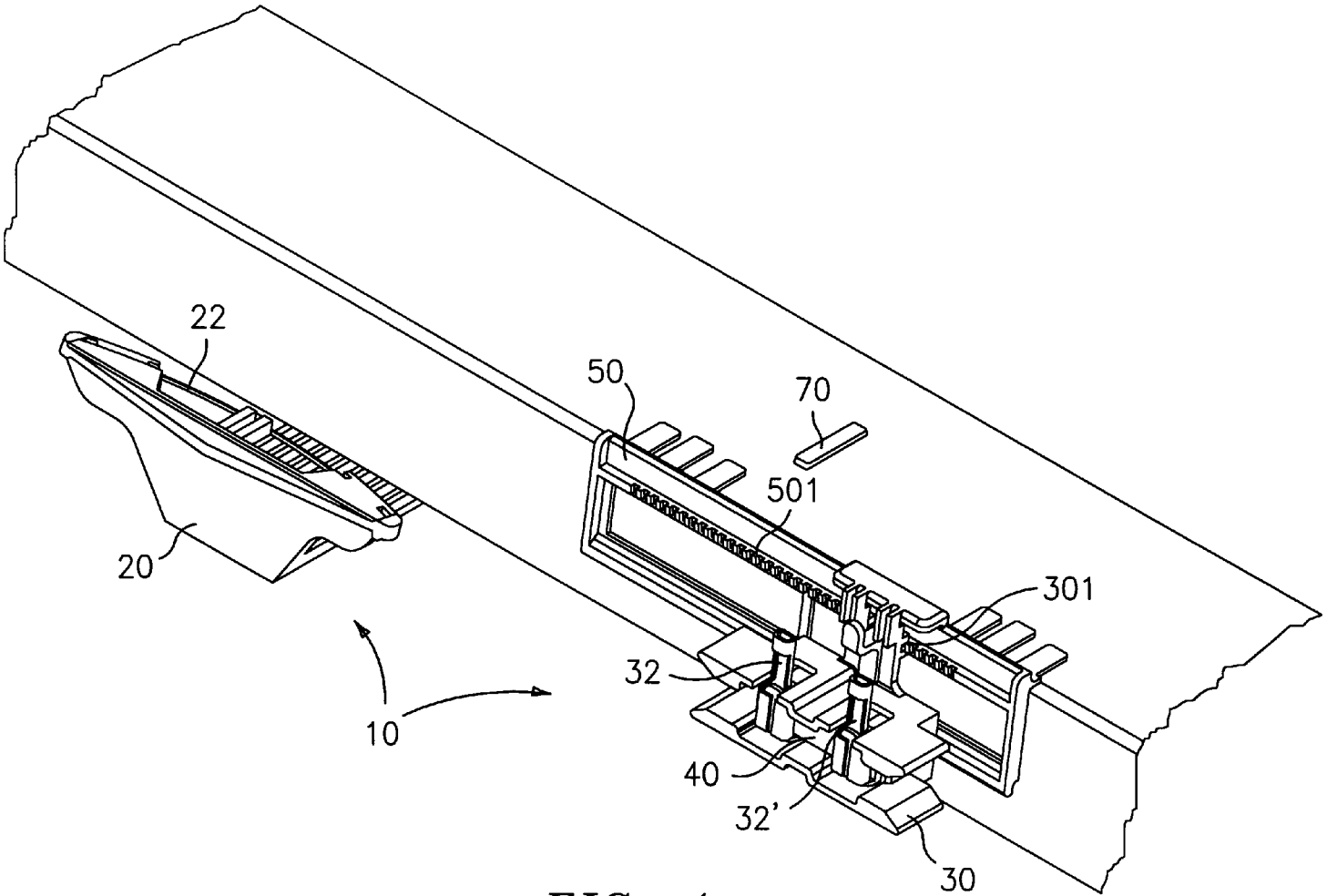
FIG. 1 is a perspective view of the limit switch, mounted, with fixed-location and movable contact frames.

Limit switch 10 shown in FIG. 1 includes contact frame 20, movable upon the opening and closing of a gate, as well as fixed-location contact frame 30. Movable contact frame 20 is placed on a cradle connected with the drive component of the gate drive. Contact frame 20 includes arc-shaped contact component 22 that is attached to the corresponding mount of contact frame 20.

Figure 2:
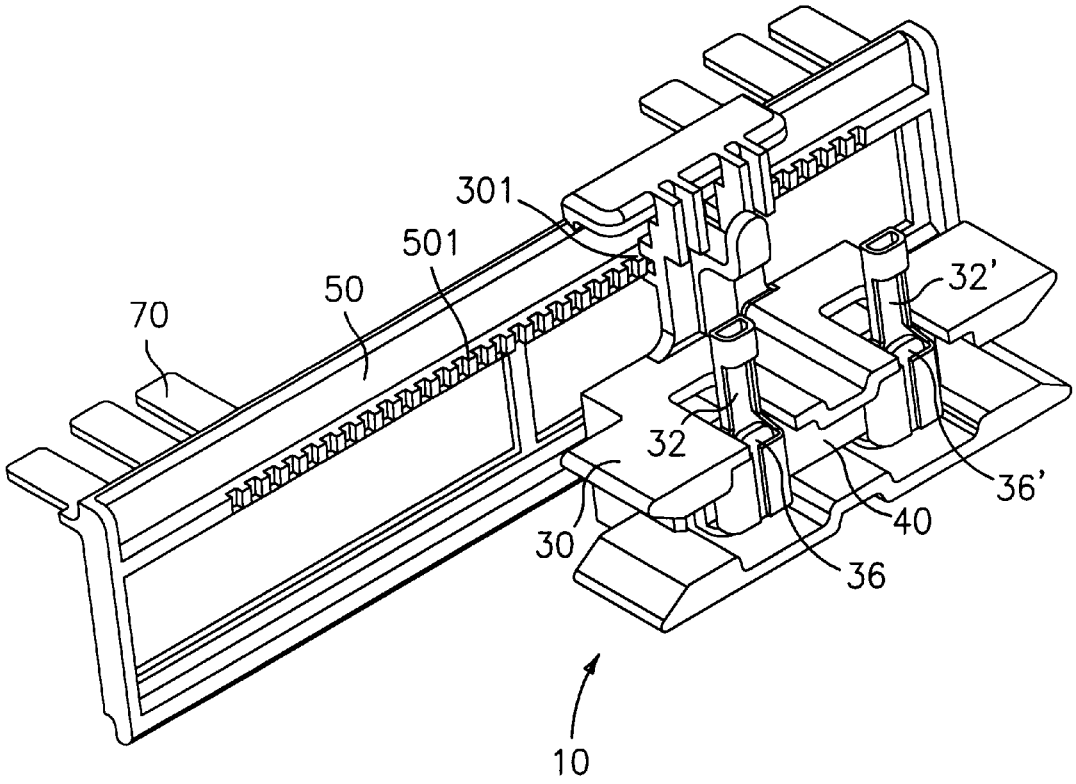
FIG. 2 is a perspective view of the fixed-location contact frame attached to the contact strip.

Contact frame 30, fixed during the opening and closing of the gate, has contact components 32 and 32'. They are mounted on projections 36 and 36', as shown in FIG. 2. Contact components 32 and 32' consist of contact shoes, resulting in a simple, inexpensive design.

Figure 3:
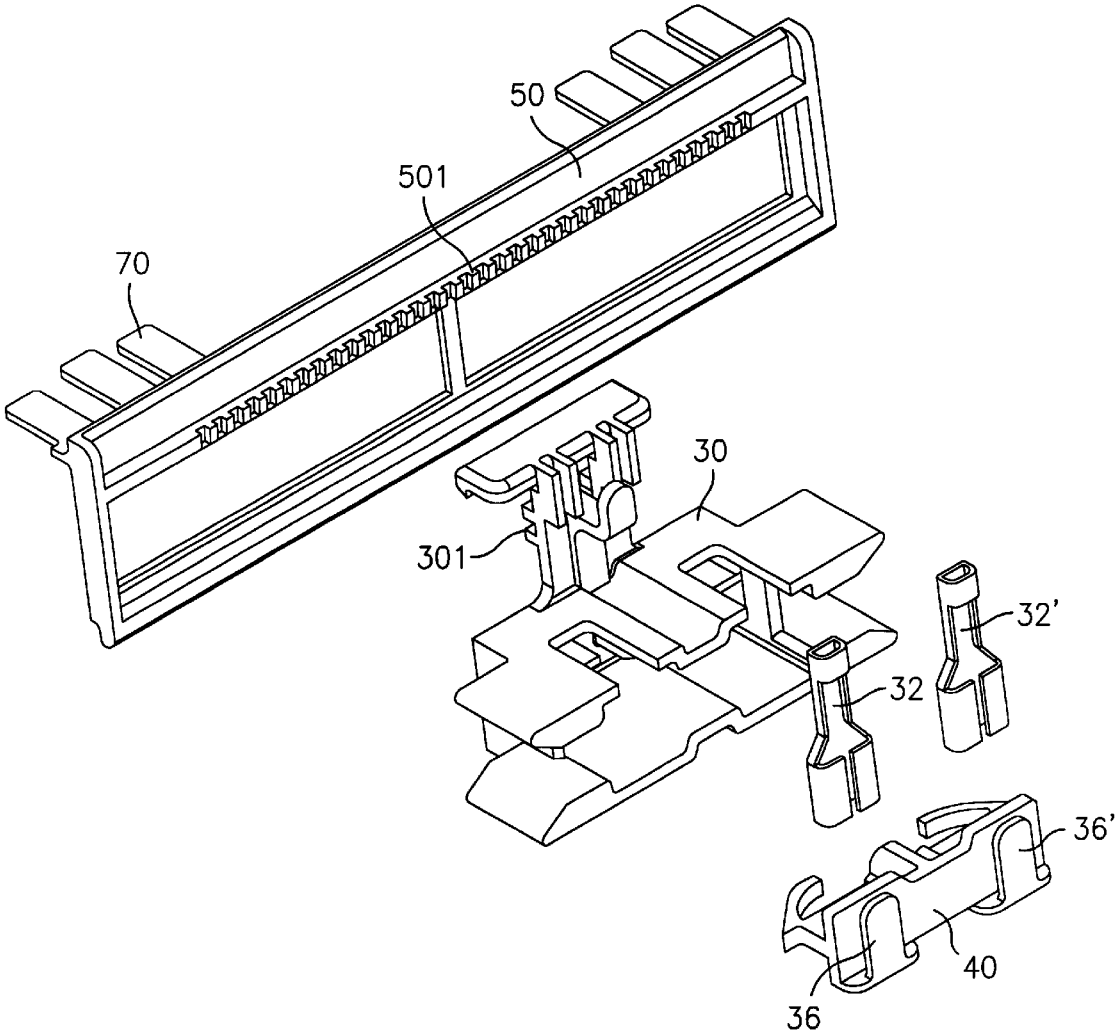
FIG. 3 is an exploded perspective view of the contact strip and contact frame with receptacle and contact components, and FIG. 4 constitute perspective views of the moved contact frame mounted on the cradle, with contact components, in a top view and in a view from below.

FIG. 3 shows that contact components 32 and 32' can be placed on projections 36 and 36' of receptacle 40 and in this state, can be inserted, with receptacle 40, into contact frame 30. Projections 36 and 36' are designed flexibly in a direction perpendicular to the front surface shown in FIG. 3, so that inserted contact components 32 and 32' can be moved in this direction.

If contact frame 20, movable upon operation of the gate, is moved toward fixed-location contact frame 30, there is contact between first contact component 22 and second contact component 32 prior to activation of the limit switch. Through the bending of first contact component 22, second contact component 32 is bent, corresponding to the dimensions of the bend, in such manner that, based on elastic projection 36, first contact component 22 exerts a corresponding force on second contact component 32. As soon as movable contact frame 20 reaches a position where first contact component 22 comes in contact with second contact component 32', an electrical connection is created between second contact components 32 and 32' so that the gate drive is interrupted in this position. If, for example, the gate is moved back into the position shown in FIG. 1, contact components 32 and 32' return to their original position due to their elastic mounting.

Figure 4:
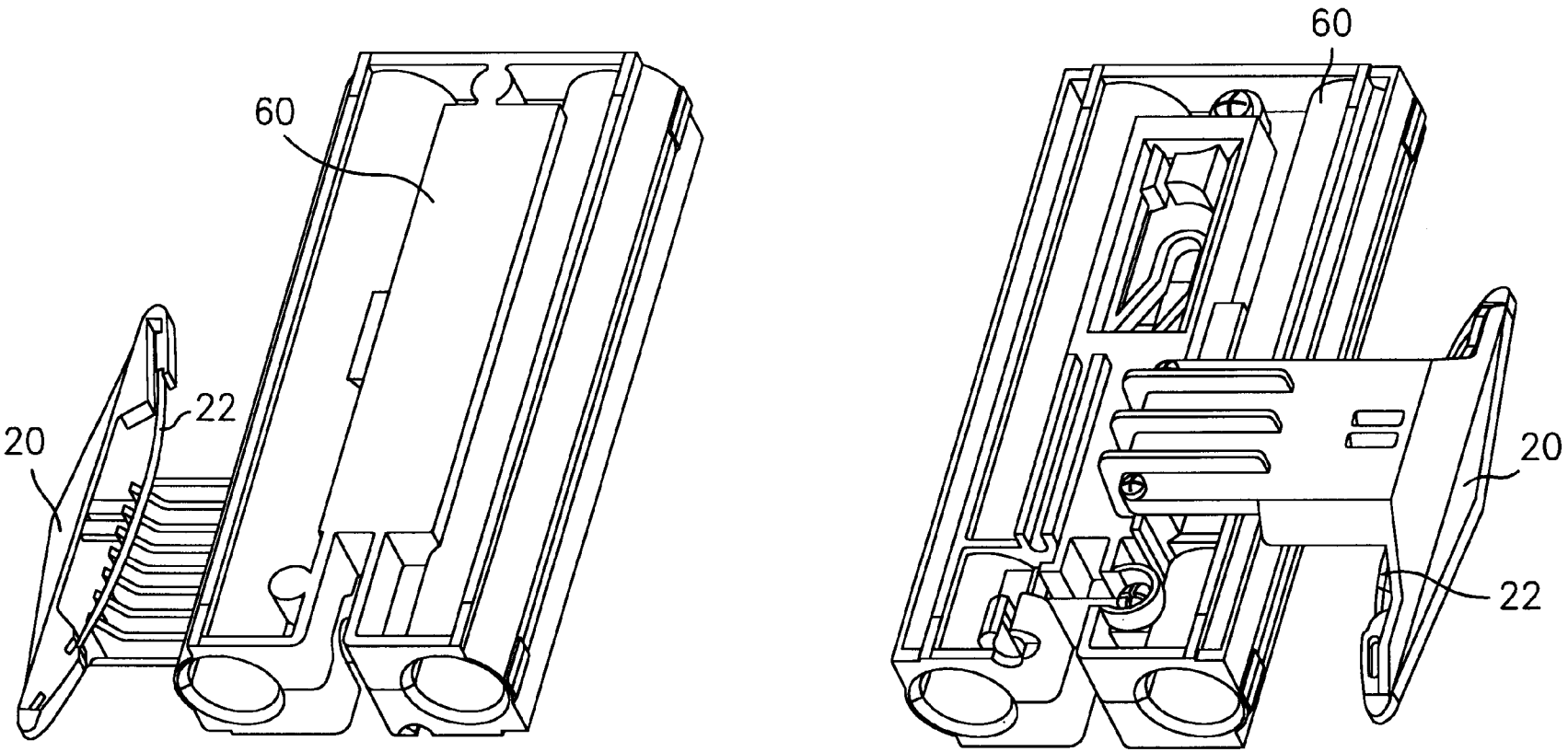

FIG. 4 shows contact frame 20 mounted on cradle 60 with arc-shaped contact component 22. Contact frame 20 is screwed to the underside of cradle 60.

FIGS. 1 through 3 show contact strip 50 attached by adhesive strip 70 to a carrier. Due to the fact that contact strip 50 can be attached to various locations on the carrier, the limit switch can be individually designed and adapted to various requirements, such as gate height or limit position. Adhesive strips 70 permit contact strip 50 to be mounted in approximately the desired position on the carrier. Fine adjustment of the switch point or the limit position of the gate can be achieved by means of spaced areas 301 and 501, which are located on fixed-location contact frame 30 as well as on contact strip 50. Contact strip 50 includes tooth profile 501 into which profile 301, corresponding to the negative image of profile 501, penetrates. Profile 301 can also be designed with a tooth profile or as a single projection that penetrates into the corresponding profile 501 on contact strip 50. If a desired position for contact frame 30 is determined, it is placed in connection with contact strip 50 by means of areas 301 and 501. After penetration of shaped areas 301 and 501, the position of contact frame 30 is altered only at need and reliably establishes the limit position of the gate in the operating state.

What is claimed is:

1. Electrical contact for a limit switch (10) for a gate drive having at least one first contact component (22) and at least one second contact component (32), in which one of the contact components (22) is arranged to move upon opening or closing a gate, characterized in that at least one first contact component (22) has a side extending in the direction of contact with the second contact component (32) and the second contact component (32) is designed to be flexible in this direction.

2. Contact pursuant to claim 1 characterized by the first contact component (22) having an arc-shaped side extending in the direction of contact with the second contact component (32).

3. Contact pursuant to claim 2, characterized in that electric contact is create by contact between the first contact component (22) and two second contact components (32, 32').

4. Contact pursuant to claim 2, characterized in that the first contact component (22) is constituted by a wire bent in the direction of contact with the second contact component (32).

5. Contact pursuant to claim 2, characterized in that the contact component (32) of fixed location during the opening and closing of the gate, can be mounted in positions spaced away from each other in the direction of motion of the movable contact component (22).

6. Contact pursuant to claim 2, characterized in that the second contact component (32) has a contact shoe that can be placed on a projection (36) of the limit switch (10), wherein the contact shoe and/or the projection (36) are designed to be flexible.

7. Contact pursuant to claim 2, having a contact frame (20) arranged to be movable upon the opening and closing of the gate (20) and a fixed-location contact frame (30), wherein one of the contact components (22) is placed on the movable contact contact frame (20) and the other contact component (32) is placed on the fixed contact frame (30).

8. Contact pursuant to claim 7, characterized in that the movable contact frame (20) is placed on a cradle (60) attached to a component of the gate drive.

9. Contact pursuant to claim 8, characterized in that the second contact component (32) has a contact shoe that can be placed on a projection (36) of the limit switch (10), wherein the contact shoe and/or the projection (36) are designed to be flexible.

10. Contact pursuant to claim 7, characterized in that the second contact component (32) has a contact shoe that can be placed on a projection (36) of the limit switch (10), wherein the contact shoe and/or the projection (36) are designed to be flexible.

11. Contact pursuant to claim 10, characterized in that one or more of projections (36, 36') are placed on the fixed contact frame (30).

12. Contact pursuant to claim 10, characterized in that one or more projections (36, 36') are arranged on a receptacle (40) that can be inserted in the fixed contact frame (30).

13. Contact pursuant to claim 7, characterized in that the fixed-location contact frame (30) can be mounted in positions spaced away from each other in the direction of motion of the movable contact component (22).

14. Contact pursuant to claim 13, characterized in that the fixed-location contact frame (30) can be attached detachably to a contact strip (50).

15. Contact pursuant to claim 14, characterized in that the contact strip (50) and the fixed-location contact frame (30) have shaped areas (301, 501) wherein the shaped area (501) of the contact strip (50) is designed as the complementary image of the shaped area (301) of the fixed-location contact frame (30).

16. Contact pursuant to claim 14, characterized in that the contact strip (50) is attached detachably to a carrier, a projection or a wall by adhesive.

17. Contact pursuant to claim 16, characterized in that the contact strip (50) is attached detachably to the carrier, the projection or the wall by adhesive strips (70).

18. Contact pursuant to claim 13, characterized in that the contact strip (50) and the fixed-location contact frame (30) have shaped areas (301, 501) where the shaped area (501) of the contact strip (50) is designed as the complementary image of the shaped area (301) of the fixed-location contact frame (30).

19. Contact pursuant to claim 18, characterized in that the contact strip (50) is attached detachably to a carrier, a projection or a wall by adhesive.

20. Contact pursuant to claim 19, characterized in that the contact strip (50) is attached detachably to the carrier, the projection or the wall by adhesive strips (70).

* * * * *